US008556601B2

(12) United States Patent
Chang

(10) Patent No.: US 8,556,601 B2
(45) Date of Patent: Oct. 15, 2013

(54) HEAT-DISSIPATING FAN ASSEMBLY

(75) Inventor: Clement Chang, Kaosiung (TW)

(73) Assignee: PC-Fan Technology Inc., Kaohsiung (TW)

( * ) Notice: Subject to any disclaimer, the term of this patent is extended or adjusted under 35 U.S.C. 154(b) by 227 days.

(21) Appl. No.: 12/638,994

(22) Filed: Dec. 16, 2009

(65) Prior Publication Data

US 2011/0142698 A1 Jun. 16, 2011

(51) Int. Cl.
*F04B 17/00* (2006.01)

(52) U.S. Cl.
USPC ..... 417/423.7; 417/420; 361/695; 310/90; 310/156.32

(58) Field of Classification Search
USPC ..... 417/420, 423.1, 423.7; 361/695; 310/90, 67, 62–63
See application file for complete search history.

(56) References Cited

U.S. PATENT DOCUMENTS 4,164,690 A * 8/1979 Muller et al. ..... 318/400.41
4,603,271 A * 7/1986 Maruyama et al. ..... 310/62
4,885,488 A * 12/1989 Cox ..... 310/68 R
5,176,509 A * 1/1993 Schmider et al. ..... 417/423.7
5,478,221 A * 12/1995 Loya ..... 417/313
5,731,953 A * 3/1998 Sakurai ..... 361/695
5,924,851 A * 7/1999 Obata et al. ..... 417/424.1
6,013,966 A * 1/2000 Fehrenbacher et al. ..... 310/257
7,019,970 B2 * 3/2006 Tanaka et al. ..... 361/695
7,428,742 B2 * 9/2008 Wu et al. ..... 720/654
7,453,696 B2 * 11/2008 Tungl et al. ..... 361/695
7,579,726 B2 * 8/2009 Chen et al. ..... 310/67 R
7,595,994 B1 * 9/2009 Sun ..... 361/721
7,619,337 B2 * 11/2009 Kasai et al. ..... 310/89
8,014,149 B2 * 9/2011 Hsu et al. ..... 361/695
2003/0143086 A1 * 7/2003 Shih et al. ..... 417/354
2004/0236420 A1 * 11/2004 Yamane et al. ..... 623/3.14
2004/0256334 A1 * 12/2004 Chen ..... 211/41.17
2005/0095151 A1 * 5/2005 Wampler et al. ..... 417/423.12
2005/0163404 A1 * 7/2005 Shishido et al. ..... 384/100
2006/0120643 A1 * 6/2006 Kurimura et al. ..... 384/119
2006/0153677 A1 * 7/2006 Winkler et al. ..... 415/220
2006/0232931 A1 * 10/2006 Obermaier ..... 361/695
2007/0114869 A1 * 5/2007 Horng et al. ..... 310/156.32
2007/0176508 A1 * 8/2007 Kasai et al. ..... 310/156.32
2007/0196221 A1 * 8/2007 Horng et al. ..... 417/420
2009/0010781 A1 * 1/2009 Yang et al. ..... 417/420
2009/0168347 A1 * 7/2009 Xiang ..... 361/695
2009/0284912 A1 * 11/2009 Cheng et al. ..... 361/679.48
2010/0097761 A1 * 4/2010 Hsieh ..... 361/695

* cited by examiner

*Primary Examiner* — Charles Freay
*Assistant Examiner* — Thomas Fink
(74) *Attorney, Agent, or Firm* — CKC & Partners Co., Ltd.

(57) ABSTRACT

A heat-dissipating fan assembly is provided. The heat-dissipating fan includes a base, a axial tube, at least one coil mounted on the base, and an impeller module having an impeller, a plurality of vanes disposed on the circumferential surface of the impeller, a shaft, and a permanent magnet. The axial tube is mounted on the base, and made of a permeability material. The shaft and the permanent magnet are disposed on the same surface of the impeller. The shaft is inserted in conjunction with the axial tube. The at least one coil is used to electrically connect with a power to interact with the permanent magnet, which in turns rotates the impeller module.

10 Claims, 7 Drawing Sheets

HEAT-DISSIPATING FAN ASSEMBLY

BACKGROUND

1. Field of Invention

The present invention relates to a heat-dissipating fan assembly, and more particularly to a heat-dissipating fan assembly using a magnetic force to couple an impeller module with an axial tube thereof.

2. Description of Related Art

As sciences and technologies evolve with the advance of time, various electronic devices for dealing with information are provided, and the rate of information being generated is accelerating. Accordingly, the heat load of such electronic devices for dealing with information increases.

For ensuring that electronic devices can be operated continuously and normally, waste heat has to be removed from the electronic devices. Accordingly, various heat-dissipating technologies and thermal systems for cooling the electronic devices are developed. Based on the medium used for cooling the electronic devices, the heat-dissipating technologies and thermal systems are generally classified to two fields, i.e. air-cooling and liquid-cooling fields. Because the electronic devices with a liquid-cooling system have some risk of damage caused by liquid contained in the liquid-cooling system, it is very critical whether the liquid is effectively sealed in the liquid-cooling system, which is a tough challenge for an engineer to apply the liquid-cooling system on the electronic devices.

Base on cost and engineering considerations, nowadays, the heat-dissipating technologies and thermal systems adopted by most electronic devices existing in the market generally belong to the air-cooling field. In an air-cooling system, one of the most important devices is a heat-dissipating fan. Air flow produced by rotating the heat-dissipating fan generates thermal convection to remove waste heat from an electronic device on which the heat-dissipating fan is disposed.

A conventional heat-dissipating fan generally includes a base, an impeller, and a plurality of vanes. The plurality of vanes are disposed on the circumferential surface of the impeller, and the impeller is mounted on the base via a shaft. Furthermore, the heat-dissipating fan further includes at least one coil and at least one magnet for driving the impeller and the plurality of vanes to generate air flow. In general, the coil or the magnet is mounted on the impeller. If the coil is mounted on the impeller, the magnet is mounted on the base. If the magnet is mounted on the impeller, the coil is mounted on the base.

There are many different structures that can be used for constructing a heat-dissipating fan. However, no matter what structure is adopted in constructing the heat-dissipating fan, the structure is always too complicated for constructing the heat-dissipating fan.

Therefore, it is needed to provide a novelty structure for constructing the heat-dissipating fan.

SUMMARY

An aspect of the present invention is to provide a heat-dissipating fan assembly, wherein an impeller module of the heat-dissipating fan assembly is coupled with a base of the heat-dissipating fan assembly via a magnet attraction.

According to one embodiment of the present invention, a heat-dissipating fan assembly is provided. The heat-dissipating fan assembly includes a base, a axial tube, at least one coil, and an impeller module in conjunction with the axial tube.

The axial tube and the at least one coil are mounted on the base, and the axial tube is made of a permeability material. The impeller module includes an impeller, a plurality of vanes disposed on the circumferential surface of the impeller, a shaft and a permanent magnet. The shaft and the permanent magnet are disposed on the same surface of the impeller. Moreover, the shaft is inserted in conjunction with the axial tube. The at least one coil is used to electrically connect with a power to interact with the permanent magnet, which in turns rotates the impeller module.

According to another embodiment of the present invention, a heat-dissipating fan assembly is provided. The heat-dissipating fan assembly includes a printed circuit board (PCB) base, a hollow tube, at least one coil, and an impeller module in conjunction with the hollow tube. The hollow tube is perpendicularly mounted on the PCB base, and made of copper and iron. A portion of the PCB base under the hollow tube does not have a penetrating hole. The at least one coil is mounted on the PCB base. The impeller module includes a permanent magnet. The at least one coil is used to electrically connect with a power to interact with the permanent magnet, which in turns rotates the impeller module.

According to an aspect of the present invention, the aforementioned embodiments at least have the advantages that, a magnetic force can be used for coupling an impeller module of a heat-dissipating fan assembly with a base of the heat-dissipating fan assembly, thereby reducing the time for constructing the heat-dissipating fan assembly, further reducing a noise, which is induced by a friction process between structures, via simplifying the complicated structures of the heat-dissipating fan assembly.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1A:
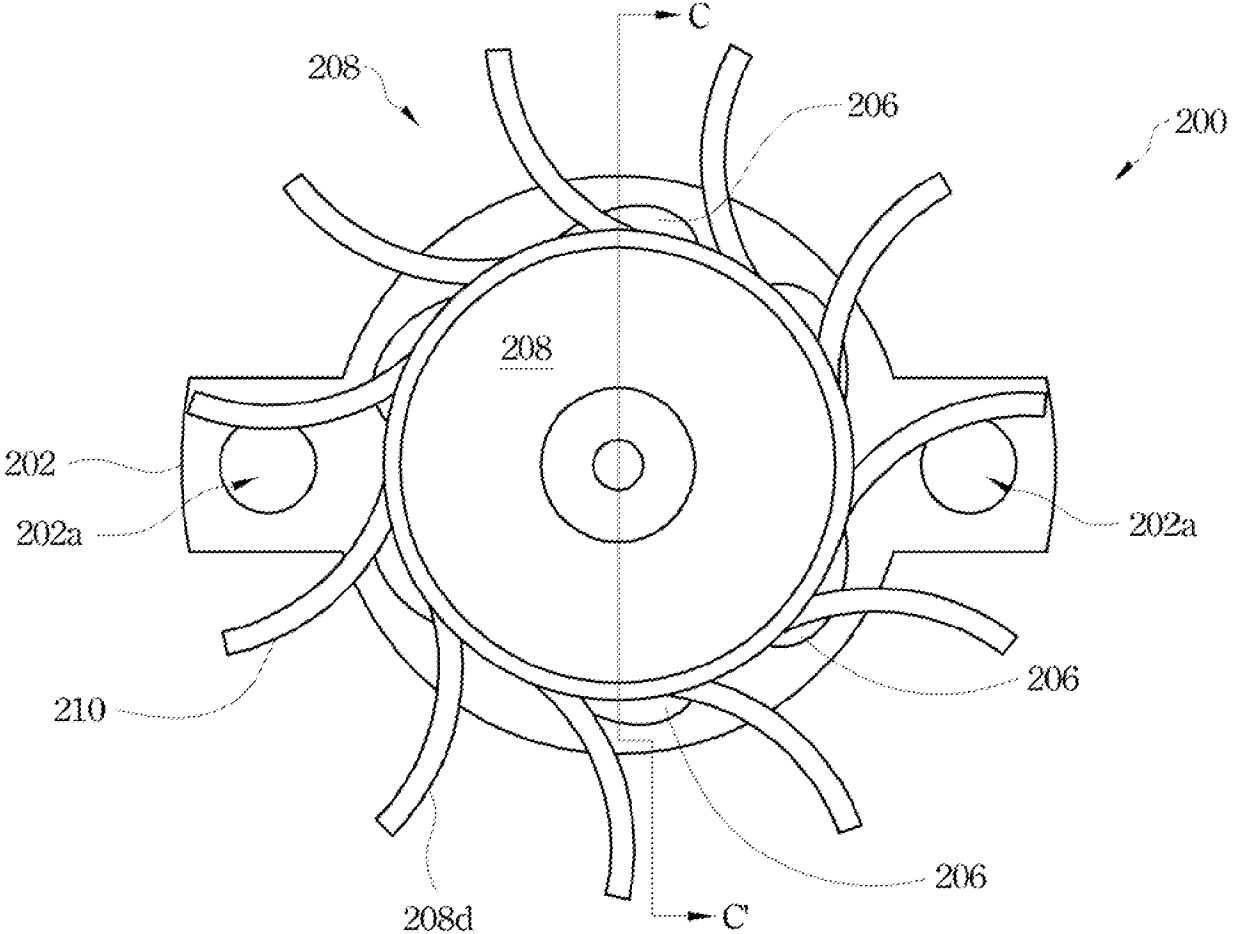
FIG. 1A is a top view of a heat-dissipating fan assembly according to one embodiment of the present invention.
Figure 1B:
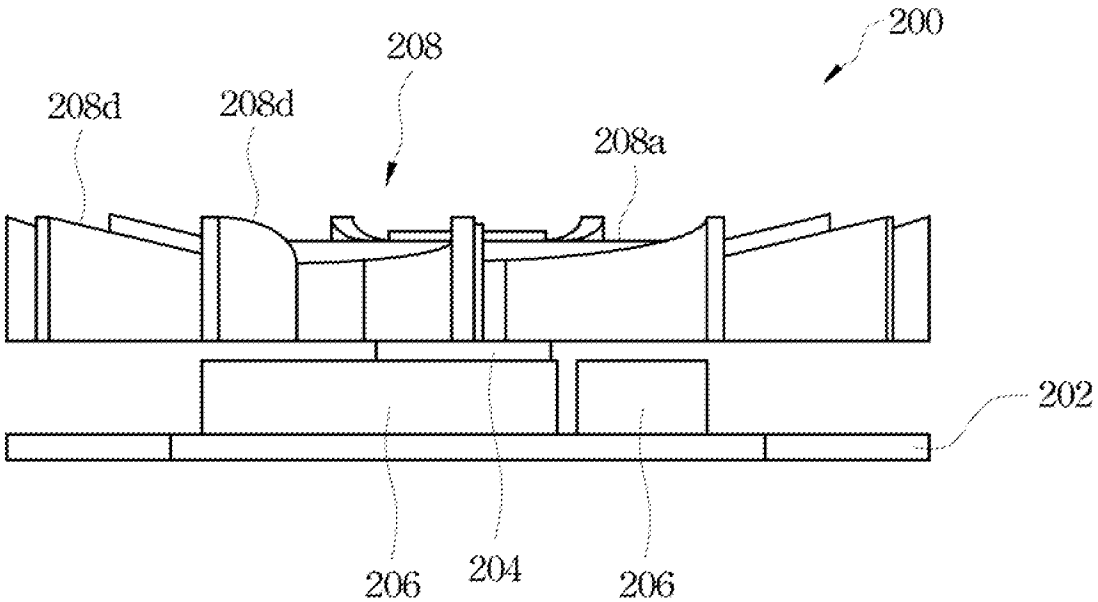
FIG. 1B is a side view of the heat-dissipating fan assembly of FIG. 1A.
Figure 1C:
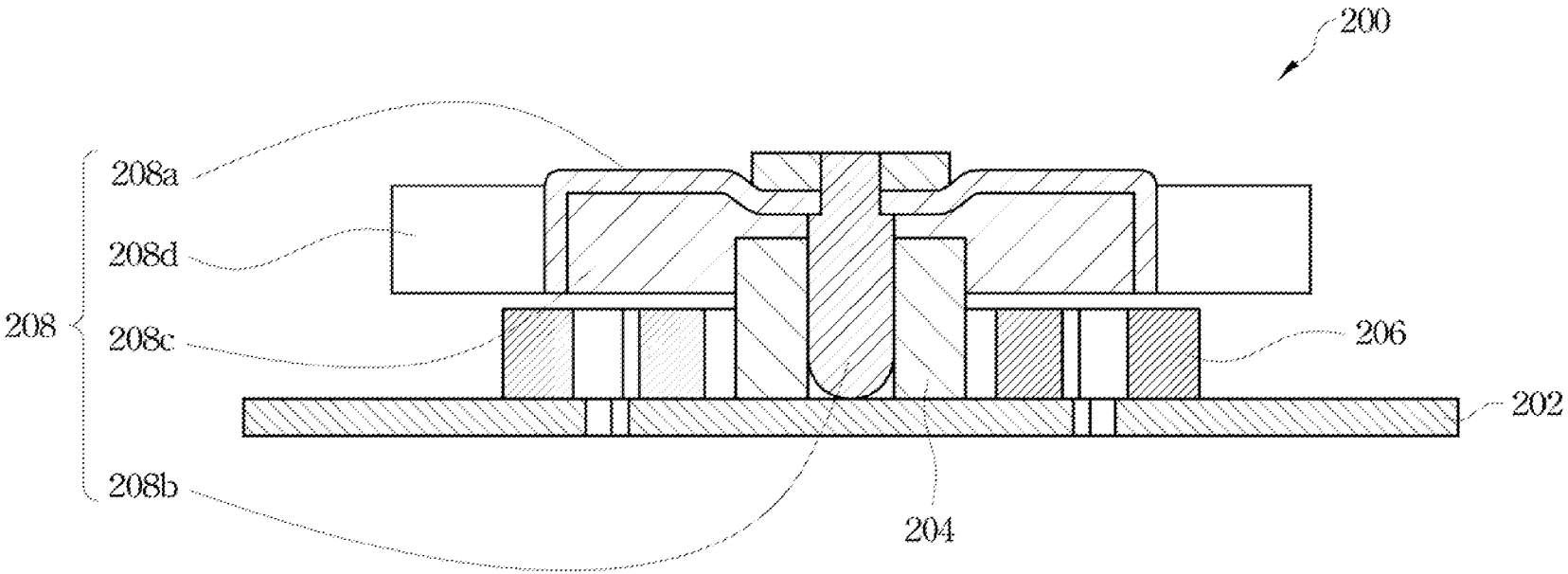
FIG. 1C is a cross-sectional view along the line C-C' of FIG. 1A.

Referring to FIGS. 1A, 1B and 1C, FIG. 1A is a top view of a heat-dissipating fan assembly 200 according to one embodiment of the present invention, and FIG. 1B is a side view of the heat-dissipating fan assembly 200 of FIG. 1A, and FIG. 1C is a cross-sectional view along line C-C' of FIG. 1A. The heat-dissipating fan assembly 200 includes a base 202, an axial tube 204 (see FIG. 1B and FIG. 1C), at least one coil 206, an impeller module 208 which is in conjunction with the axial tube 204. The impeller module 208 includes an impeller 208*a*, a plurality of vanes 208*d*, a shaft 208*b* (see FIG. 1C), and a permanent magnet 208*c* (see FIG. 1C). The vanes 208*d* are disposed on the circumferential surface of the impeller 208*a*. In this embodiment, the vanes 208*d* and the impeller 208*a* are integrally formed as one unit, but in some certain embodiments, a plurality of vanes and an impeller can be formed separately and then joined together. The shape and quantity of vanes can vary with performance requirements of the heat-dissipating fan assembly, and are not limited to this embodiment.

Figure 1D:
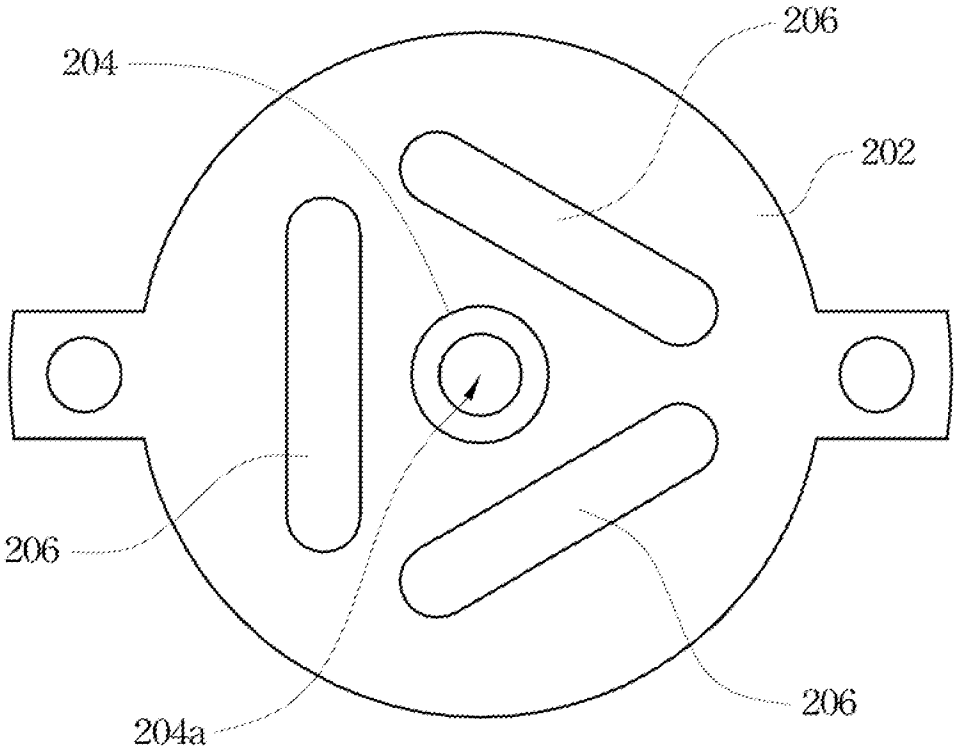
FIG. 1D is a top view of the base, the axial tube, and the coils of FIG. 1A and FIG. 1B.

Please refer to FIGS. 1A, 1B, 1C and 1D. FIG. 1D is a top view of the base 202, the axial tube 204, and the coils 206 of FIGS. 1A, 1B and 1C. The axial tube 204 and the coils 206 are mounted on the base 202. In this embodiment, the number of the coils 206 is three, and the coils 206 are uniformly disposed around the axial tube 204. In certain embodiments, the number of the coils can vary with performance requirements of the heat-dissipating fan assembly. The axial tube 204 has an axial hollow 204*a* for receiving the impeller 208, and is made of a permeability material. In this disclosure, the permeability material is meant that the material can be attracted by a magnetic force but cannot provide a magnetic force. By the word "magnet", it is meant that a subject can provide a magnetic force for attracting another subject made of a permeability material.

In this embodiment, the axial tube 204 is a hollow tube and perpendicularly mounted on the base 202 (see FIG. 1C). In certain embodiments, an axial tube can be a tube having a bottom portion disposed on a base of a heat-dissipating fan assembly. In certain embodiments, an axial tube can be mounted on but not perpendicular to a base of a heat-dissipating fan assembly. Moreover, in this embodiment, a portion of the base 202 under the axial tube 204 does not have a penetrating hole (see FIG. 1C); that is to say, the shaft 208*b* is supported directly by the base 202.

In this embodiment, the axial tube 204 is made of a permeability material. For example, the axial tube 204 can be made of iron. In certain embodiment, the axial tube can be made of copper and iron, and fabricated by metallurgy.

Figure 1E:
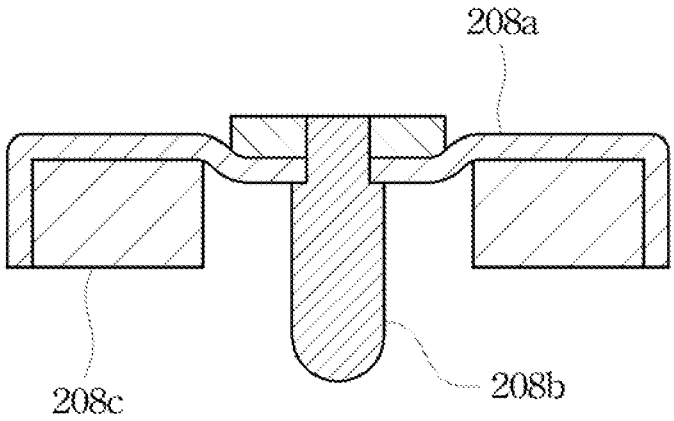
FIG. 1E is a cross-sectional view of the impeller module of FIG. 1C without the vanes.

Please refer to FIGS. 1A to 1E. FIG. 1E is a cross-sectional view of the impeller module 208 of FIG. 1C without the vanes 208*d*. In this embodiment, the impeller 208*a* and the shaft 208*b* is formed separately and then joined together, but in some certain embodiments, the impeller and the shaft can be integrally formed as one unit.

Figure 1F:
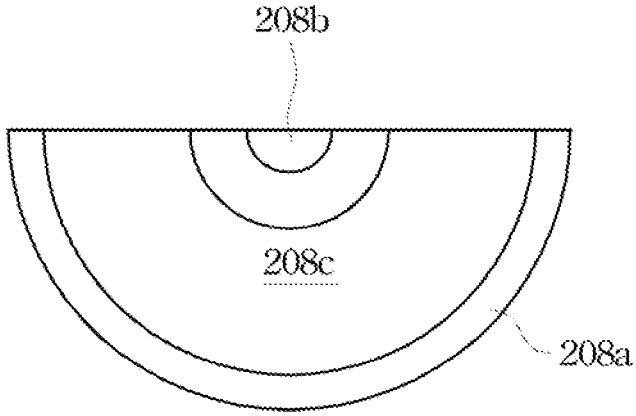
FIG. 1F is a bottom view of the impeller module of FIG. 1E without the vanes.

The shaft 208*b* and the permanent magnet 208*c* are disposed on the same surface of the impeller 208*a* (see FIG. 1E). Moreover, in this embodiment, the impeller 208*a* has a circumferential wall to form a receiving space in which the permanent magnet 208*c* is located. Referring to FIG. 1F, FIG. 1F is a bottom view of the impeller module 208 of FIG. 1E without the vanes 208*d*. The permanent magnet 208*c* continuously surrounds the shaft 208*b*, and there is a gap between the shaft 208*b* and the permanent magnet 208*c*.

Figure 2A:
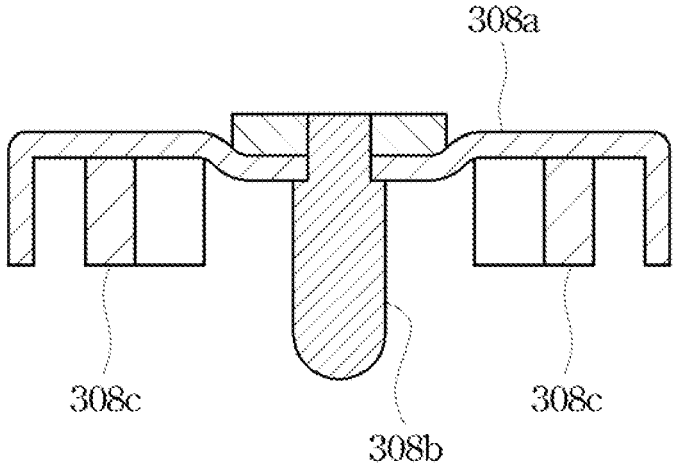
FIG. 2A is a cross-sectional view of an impeller module without vanes according to another embodiment of the present invention.
Figure 2B:
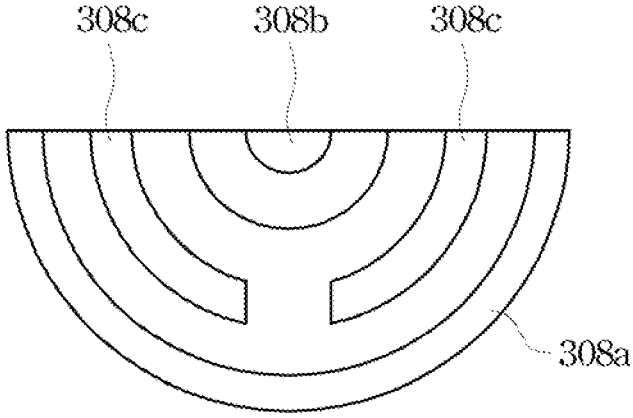
FIG. 2B is a bottom view of the impeller module of FIG. 2A without vanes.

Referring to FIGS. 2A and 2B, FIG. 2A is a cross-sectional view of the impeller module 308 without vanes according to another embodiment of the present invention, and FIG. 2B is a bottom view of the impeller module 308 of FIG. 2A without vanes. The structures of the impeller module 308 are similar to that of the impeller module 208 shown in FIGS. 1E and 1F. The impeller module 308 also has an impeller 308*a*, a shaft 308*b* and a permanent magnet 308*c*, wherein the impeller 308*a* and the shaft 308*b* are substantially and respectively the same with the impeller 208*a* and the shaft 208*b*. The description of the same structures obtained by the impeller module 208 and the impeller module 308 will not be repeated. The different structures between the impeller module 208 and the impeller module 308 are the permanent magnet 208*c* and the permanent magnet 308*c*. The permanent magnet 308*c* is located in a receiving space formed in the impeller 308*a* but does not continuously surround the shaft 308*b*. Moreover, there is another gap between the permanent magnet 308*c* and the circumferential wall of the impeller 308*a*, besides the gap between the permanent magnet 308*c* and the shaft 308*b*. On the contrary, the permanent magnet 208*c* continuously surrounds the shaft 208*b*, and there is no gap between the permanent magnet 208*c* and the circumferential wall of the impeller 208*a*. In certain embodiments, the impeller module can have various structures other than those that are shown in FIGS. 1E, 1F, 2A, and 2B.

Please refer to FIGS. 1A to 1F again. When the heat-dissipating fan assembly 200 has been assembled, the shaft 208*b* is inserted in the axial hollow 204*a* of the axial tube 204. In this embodiment, due to that the clearance between the shaft 208*b* and the axial tube is extremely small after the shaft 208*b* has been inserted in the axial hollow 204*a* of the axial tube 204, there is almost no air sealed in the space of the axial hollow 204*a*. Therefore, a force is provided by the ambient pressure to push the shaft 208*b* into the axial hollow 204*a* of the axial tube 204. The force provided by the ambient pressure cooperates with the magnetic force provided by the permanent magnet 208*c* to prevent the impeller module 208 from departing from the axial hollow 204*a* while the heat-dissipating fan assembly 200 is during rotation.

The three coils 206 are used to electrically connect with a power. After electricity is provided to the coils 206, the coils 206 can interact with the permanent magnet 208*c* of the impeller module 208. The interaction between the coils 206 and the permanent magnet 208*c* of the impeller module 208 can rotates the impeller module 208, and therefore the vanes 208*d* disposed on the circumferential surface of the impeller 208*a* can produce air flow for dissipating heat generated from an electronic device.

Due to that the impeller module 208 of the heat-dissipating fan assembly 200 couples with the base 202 of the heat-dissipating fan assembly 200 via the magnet force provided by the permanent magnet 208*c*, the time for constructing the heat-dissipating fan assembly 200 can be reduced. Moreover, because a method, such as a riveting method, which is used in constructing a conventional heat-dissipating fan, is replaced by the method using a magnetic force for coupling the impeller module with the base; the heat-dissipating fan assembly 200 has more simple structures than that of the conventional heat-dissipating fan. Therefore, a noise induced by a friction process between structures can be reduced.

Because the shaft 208*b* of the impeller module 208 is not fixed in the axial tube 204, it is convenient for repairing the heat-dissipating fan assembly 200 while the impeller module 208 is damaged. Moreover, the shaft 208*b* of the impeller module 208 does not penetrate through the base 202, and thereby the to impeller module 208 does not have a structure for fixing the shaft 208*b* with the base 202. Therefore the thickness of the heat-dissipating fan assembly 200 can be reduced.

In the embodiment shown in FIGS. 1A to 1F, for improving the durability of the heat-dissipating fan assembly 200, the permanent magnet 208*c* of the impeller module 208 does not contact with the three coils 206. There is a gap between the permanent magnet 208*c* the coils 206 (see FIG. 1B). In FIG. 1C, the permanent magnet 208*c* also does not contact with the axial tube 204. If a permanent magnet contacts with an axial tube made of a permeability material, the coils used to interact with the permanent magnet need a relatively large start voltages for overcoming the relatively large magnet attraction between the permanent magnet and the axial tube. On the contrary, due to no contacting between the permanent magnet 208*c* and the axial tube 204, the impeller module 208 can start to rotate relatively easily.

In the embodiment shown in FIG. 1A, for mounting the heat-dissipating fan assembly 200 on a substrate, the base 202 of the heat-dissipating fan assembly 200 further includes two fixing holes 202*a*. In certain embodiments, a heat-dissipating fan assembly can be mounted on a substrate via other mounting methods, such as a welding method, and an adhesion method, etc.

In certain embodiments, for improving the durability and efficiency of a heat-dissipating fan assembly during rotation, the heat-dissipating fan assembly further includes a bearing (not shown) received in the axial tube of the heat-dissipating fan assembly.

In certain embodiments, for relatively efficiently controlling the direction of air flow generated by a plurality of vanes of a heat-dissipating fan assembly, the heat-dissipating fan assembly further includes a housing (not shown). The housing covers the impeller module, and the housing has at least one air inlet (not shown) and at least one air outlet (not shown) on a wall thereof. Moreover, the housing also can prevent the impeller module, especially the vanes, from damages caused by a hitting from an object.

Figure 3:
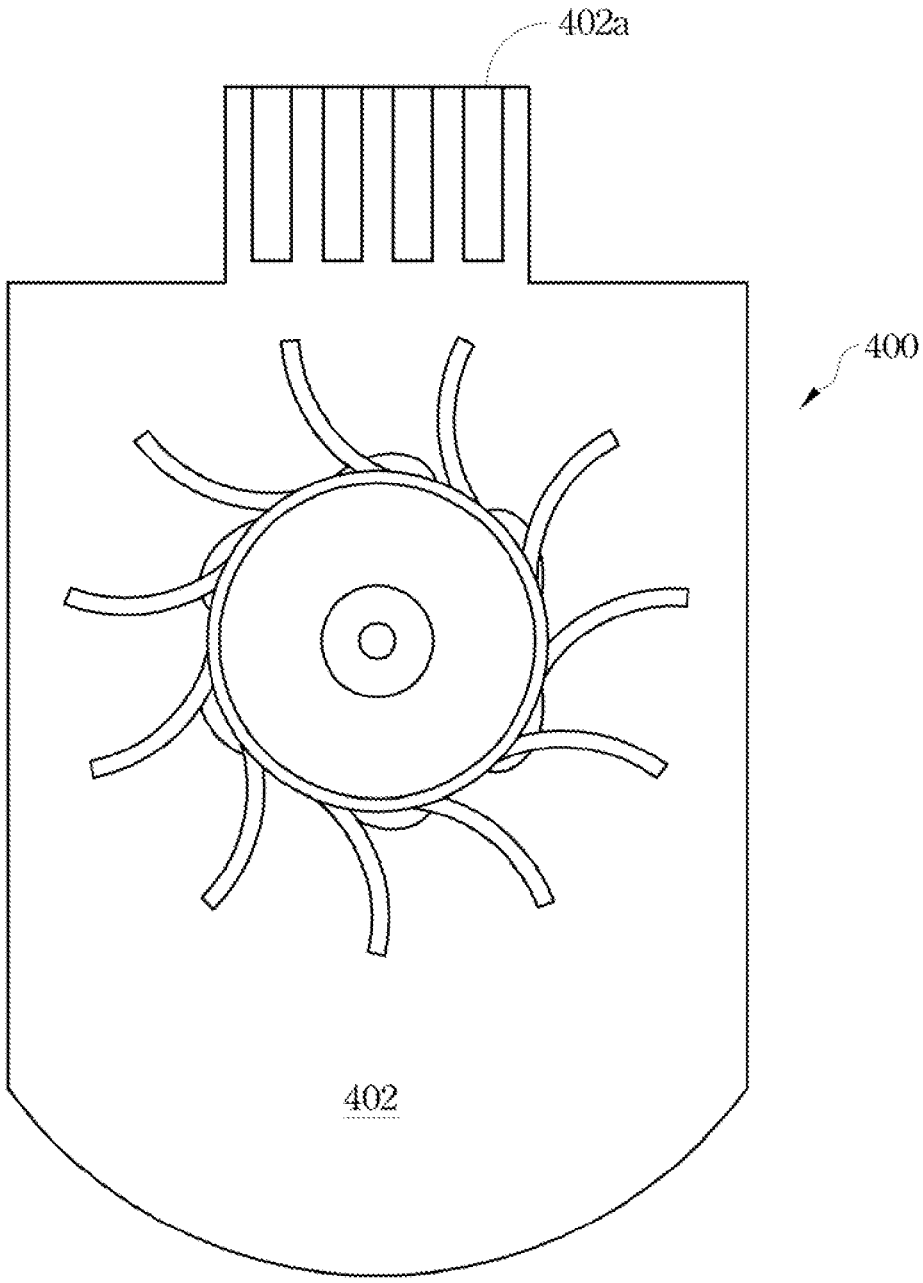
FIG. 3 is a top view of a heat-dissipating fan assembly according to another embodiment of the present invention.

Referring to FIG. 3, FIG. 3 is a top view of a heat-dissipating fan assembly 400 according to another embodiment of the present invention. The structures of the heat-dissipating fan assembly 400 are similar to that of the heat-dissipating fan assembly 200 shown in FIG. 1A. The description of the same structures obtained by the heat-dissipating fan assembly 200 and 400 will not be repeated. The different structures between the heat-dissipating fan assembly 200 and 400 are the base 202 and the printed circuit board (PCB) base 402. In this embodiment, the heat-dissipating fan assembly 400 includes a PCB base 402, wherein some wires working as a medium for transferring electricity or signals are directly printed on a base to form the PCB base 402. Furthermore, the PCB base 402 further includes at least one gold finger 402*a*. Through the PCB base 402 and the gold finger 402*a* of the PCB base 402, the electricity is provided from a power to at least one coil of the heat-dissipating fan assembly 400, or a signal is provided from an electronic device to control the rotation of the impeller module of the heat-dissipating fan assembly 400.

Although the present invention has been described in considerable detail with reference to certain embodiments thereof, other embodiments are possible. Therefore, their spirit and scope of the appended claims should no be limited to the description of the embodiments container herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A heat dissipating fan assembly; comprising:

a carrier consisting of:

a PCB base consisting of a base and a plurality of wires, wherein the wires working as a medium for transferring electricity or signals are directly printed on the base to form the PCB base;

an axial tube mounted on the PCB base and made of a permeability material comprising iron, wherein a portion of the PCB base under the axial tube does not have a penetrating hole; and at least one coil mounted on the PCB base; and an impeller module mounted to the axial tube, wherein the impeller module comprises:

an impeller;

a plurality of vanes disposed on the circumferential surface of the impeller;

a shaft directly inserted into the axial tube; and a permanent magnet mounted directly around the radially outer surface of the axial tube for attracting the axial tube;

wherein the shaft and the permanent magnet are disposed on the same surface of the impeller, and the impeller module is coupled with the PCB base via a magnet attraction between the permanent magnet arid the axial tube;

wherein the at least one coil is electrically connected with a power via the PCB base to interact with the permanent magnet, which in turns rotates the impeller module.

2. The heat-dissipating fan assembly of claim 1, wherein the axial tube is made of copper and iron.

3. The heat-dissipating fan assembly of claim 1, wherein the axial tube is a hollow tube perpendicularly mounted on the base.

4. The heat-dissipating fan assembly of claim 1, wherein the permanent magnet does not contact the at least one coil.

5. The heat-dissipating fan assembly of claim 1, wherein the permanent magnet does not contact the axial tube.

6. The heat-dissipating fan assembly of claim 1, wherein the number of the at least one coil is greater than one, and the coils are uniformly disposed around the axial tube.

7. A heat dissipating fan assembly; comprising:

a carrier consisting of:

a PCB base consisting of a base and a plurality of wires, wherein the wires working as a medium for transferring electricity or signals are directly printed on the base to form the PCB base;

an hollow tube perpendicularly mounted on the PCB base and made of copper and iron, wherein a portion of the PCB base under the hollow tube does not have a penetrating hole; and at least one coil mounted on the PCB base; and an impeller module mounted to the hollow tube and comprising:

a permanent magnet mounted directly around the radially outer surface of the hollow tube for attracting the hollow tube;

an impeller having a receiving space in which the impeller is located;

a plurality of vanes disposed on the circumferential surface of the impeller; and a shaft directly inserted in the hollow tube;

wherein the impeller module is coupled with the PCB base via a magnet attraction between the permanent magnet arid the hollow tube;

wherein the at least one coil is electrically connected with a power via the PCB base to interact with the permanent magnet, which in turns rotates the impeller module.

8. The heat-dissipating fan assembly of claim 7, wherein the permanent magnet does not contact the at least one coil.

9. The heat-dissipating fan assembly of claim 7, wherein the permanent magnet does not contact the hollow tube.

10. The heat-dissipating fan assembly of claim 7, wherein the number of the at least one coil is greater than one, and the coils are uniformly disposed around the hollow tube.

* * * * *